US007367478B2

(12) United States Patent
Fuchs

(10) Patent No.: US 7,367,478 B2
(45) Date of Patent: May 6, 2008

(54) DOSING DEVICE FOR AT LEAST ONE MEDIUM

(75) Inventor: Karl-Heinz Fuchs, Radolfzell (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 481 days.

(21) Appl. No.: 10/876,332

(22) Filed: Jun. 24, 2004

(65) Prior Publication Data

US 2004/0265157 A1 Dec. 30, 2004

(30) Foreign Application Priority Data

Jun. 25, 2003 (EP) ..... 03014248

(51) Int. Cl.
*B67D 5/00* (2006.01)

(52) U.S. Cl. ..... 222/341; 222/321.6; 222/321.8; 222/321.9; 222/378

(58) Field of Classification Search ..... 222/341, 222/321.1, 321.6–321.9, 383.1, 383.3, 372, 222/378–382; 239/333
See application file for complete search history.

(56) References Cited

U.S. PATENT DOCUMENTS

| | | | | |
|---|---|---|---|---|
| 5,316,198 | A * | 5/1994 | Fuchs et al. | 222/321.2 |
| 5,979,711 | A * | 11/1999 | Fuchs et al. | 222/321.2 |
| 6,073,814 | A * | 6/2000 | Fuchs | 222/321.1 |
| 6,209,760 | B1 * | 4/2001 | Fuchs | 222/321.6 |
| 6,729,505 | B2 * | 5/2004 | Ramsey et al. | 222/321.9 |
| 6,866,168 | B2 * | 3/2005 | Petit | 222/321.9 |

* cited by examiner

*Primary Examiner*—J. Casimer Jacyna
(74) *Attorney, Agent, or Firm*—Flynn, Thiel, Boutell & Tanis, P.C.

(57) ABSTRACT

A dosing device for at least one medium includes a casing part connectable to a medium reservoir, having a pumping device located in the casing part and an applicator connected to the pumping device. The pumping device is provided with at least one inlet valve, as well as at least one outlet valve associated with the applicator and a stroke-movable pumping body. The casing part, applicator and all parts of the pumping device are provided coaxially to a pumping axis with plug connection sections. The casing part, applicator and the parts of the pumping device can be functionally assembled along the pumping axis to form the dosing device.

11 Claims, 1 Drawing Sheet

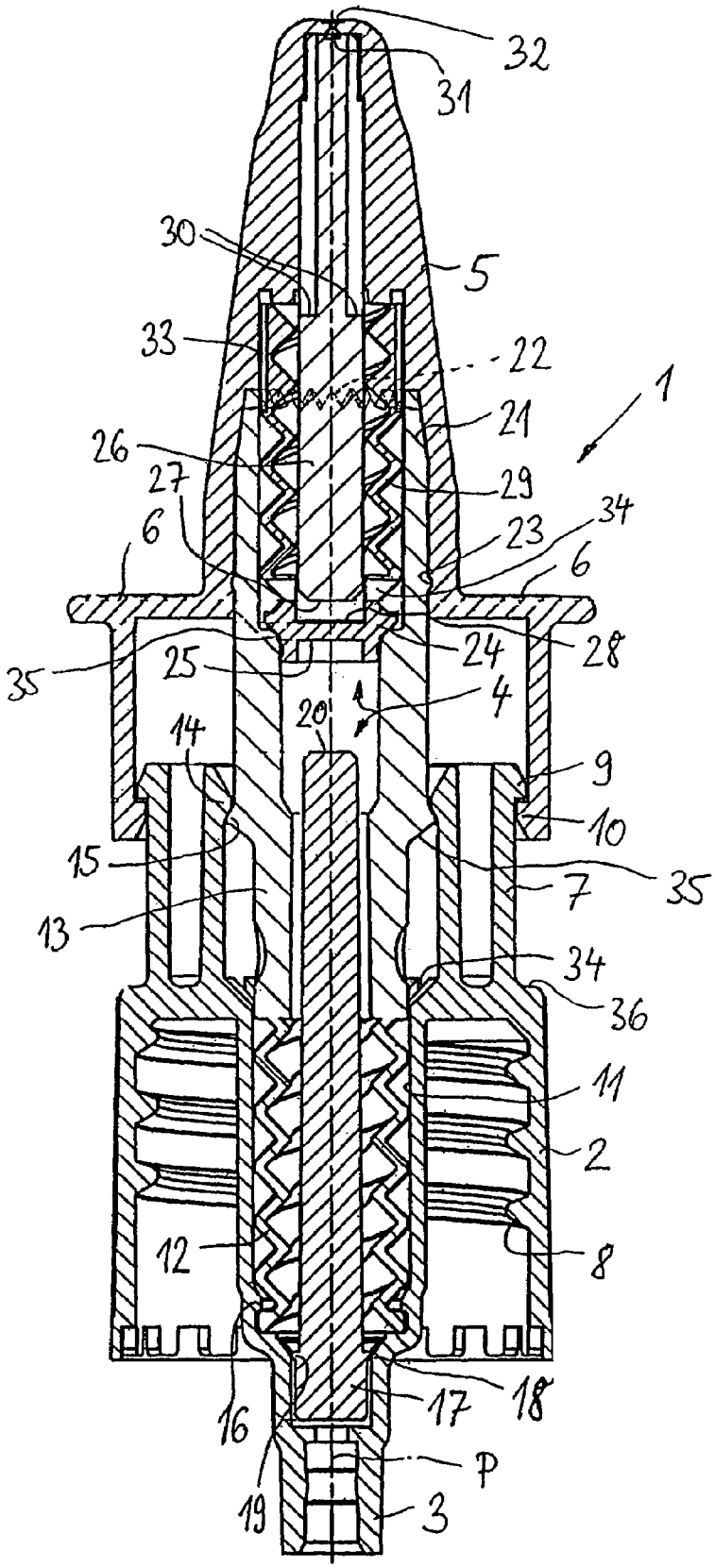
32
31
30
5
33
22
1
21
26
29
27
34
6
23
6
35
25
24
28
4
20
14
9
10
15
35
7
13
34
36
11
2
12
8
16
17
18
P
19
3

DOSING DEVICE FOR AT LEAST ONE MEDIUM

CROSS-REFERENCE TO RELATED APPLICATIONS

The following disclosure is based on European Patent Application 03014248.3 filed on Jun. 25, 2003, which is incorporated into this application by reference.

FIELD OF THE INVENTION

The invention relates to a dosing device for at least one medium having a casing part connectable to a medium reservoir, a pumping device located in the casing part, as well as an applicator connected to the pumping device, the latter having at least one inlet valve, as well as at least one outlet valve associated with the applicator and a stroke-movable pumping body.

BACKGROUND OF THE INVENTION

Such a dosing device is generally known for pharmaceutical or cosmetic media such as liquids, gels, etc. The known dosing device is firmly connected to a medium reservoir by means of a casing part, which is provided with a closing cap. The dosing device has a pumping device in the form of a manually operable thrust piston pump. With the thrust piston pump is associated an applicator constructed as a nose olive provided with a finger support for the manual operation of the pumping device.

SUMMARY OF THE INVENTION

The problem of the invention is to provide a dosing device of the aforementioned type, which is simple and inexpensive to manufacture and which functions reliably.

This problem is solved in that the casing part, the applicator and all parts of the pumping device are provided, coaxially to a pumping axis, with plug connection sections by means of which the casing part, the applicator and the parts of the pumping device are assemblable ready for functioning along the pumping axis to form the dosing device. As a result of the solution according to the invention it is possible in an extremely simple and inexpensive manner to obtain a functioning dosing device. The solution according to the invention is particularly suitable for the manufacture in large numbers of dosing devices. Preferred fields of use are for cosmetic or pharmaceuticals. The plug connection sections permit an axial assembly of the dosing device parts. They are also constructed in such a way that for the assembled functioning state of the parts relative to one another corresponding position locking means are obtained. The plug connection sections make it possible to mechanically assemble the dosing device by means of an assembly device.

As a function of the intended use, the applicator is adapted to different types of application forms. In particularly preferred manner the applicator is constructed as a nose olive.

According to a development of the invention, the pumping body and a bellows spring elastically restoring the pumping body following a pumping movement, are designed in the form of a common, integral pumping component. This reduces the number of components present within the dosing device. The pumping component is preferably made from plastic. The pumping body is dimensionally stable, whereas the bellows spring is elastically flexible.

According to a further development of the invention, the pumping body and bellows spring form a common pumping area for the medium. Thus, the pumping body and bellows spring are preferably constructed as a through hollow body. The pumping area is used for delivering the medium from the medium reservoir to the applicator and therefore to a corresponding outlet or application opening.

As a further development of the invention, part of the pumping device is constituted by a plunger arranged coaxially in the pumping area and which forms the inlet valve for the latter. On its front region facing the medium reservoir, the plunger preferably has a valve disk, which is matched to a casing-side, corresponding valve seat. The plunger is longitudinally movable relative to the pumping area and therefore relative to the pumping body and bellows spring, an opening and closing of the plunger and therefore the inlet valve being dependent on the pressure conditions between the pumping area of the pumping device on the one hand and the medium reservoir on the other.

According to a further development of the invention, an outlet valve is more particularly provided at the outlet side of the pumping area. In another development the outlet valve is integrally shaped onto an in particular outlet-side bellows spring. The outlet valve permits a pressure compensation within the pumping device so that, independently of the operating force of an operator of the dosing device, there is a uniform application under a clearly defined pressure. This construction reduces the number of components necessary and also a particularly precise dosing can be obtained.

In a further development of the invention, the outlet valve has a sealing section acting radially to the pumping axis. This leads to a particularly good sealing function, so that a precise dosing can be obtained.

According to a further development of the invention, an axially acting sealing area is additionally provided at the outlet valve.

The combination of a radially acting sealing section and an axially acting sealing area ensures a particularly good sealing action. The radially acting sealing section is preferably constituted by a cylindrical section of the outlet valve, which cooperates in axially non-positive manner with a corresponding hollow cylindrical pumping area section. The axially acting sealing area is preferably a conical sealing surface, which takes over both the axial and radial sealing action. However, the radially acting sealing section is constructed in a solely radially acting manner. The additional axially acting sealing area is axially spaced from the radially acting sealing section on the outlet valve.

According to a further development of the invention, an axial spacing of the plunger with respect to the outlet valve, in each case in their closed position, is smaller than a maximum operating stroke or travel of the pumping device. In addition, the spacing of the outlet valve from a filler of the applicator is smaller than the difference between the maximum operating stroke of the pumping device and the axial spacing of the plunger from the outlet valve, in each case relative to the closed position. During an operating stroke, the plunger opens the outlet valve mechanically, because the outlet valve is seated in its closed position with increased sealing forces. The pressure for the discharge of the medium is preferably independent of the operating force of the operator with which the operating stroke for the pumping device has been obtained. The sum of the axial spacings of an upper filler with respect to the outlet valve on the one hand and the plunger to the outlet valve on the other, in each case considered with the parts in the closed position, defines the maximum dosing or operating stroke for the pumping device. Thus, on reaching said dosing stroke, said parts of the pumping device run head-on against blocks. Thus, a clearly defined filling of the pumping device can be obtained.

According to a further development of the invention, the applicator and the pumping body are engaged in one another so as to prevent turning or twisting. This ensures a particularly good securing of the position between the applicator and the pumping body. Moreover, in the case of a bellows spring, which transfers torsional forces in addition to the lifting forces, it is ensured that during a stroke operation the bellows spring can also absorb corresponding torsional forces.

According to a further development of the invention, all parts of the pumping device, applicator and casing part are made from plastic. This allows a particularly simple and inexpensive manufacture of the dosing device, which allows a preferred suitability for uses where large numbers are needed.

Further advantages and features of the invention can be gathered from the following description of a preferred embodiment of the invention, the claims and the single drawing showing on a greatly increased scale a section through an embodiment

BRIEF DESCRIPTION OF THE DRAWINGS

FIG. 1 is a cross-sectional view of a dosing device according to the invention. of a dosing device according to the invention.

DETAILED DESCRIPTION OF THE INVENTION

A dosing device 1, as shown in the single drawing, is provided for the discharge of at least one medium for cosmetic or pharmaceutical purposes. According to the embodiment shown, the dosing device 1 is assembled entirely from plastic parts. All parts of the dosing device 1 are manufactured as plastic injection mouldings and are assembled coaxially to one another and to a pumping axis P. The dosing device 1 has a dimensionally stable casing part 2, which for the connection of the dosing device 1 to a medium reservoir, is preferably provided with a bottle-like container. For this purpose the casing part 2 has a cap-like closure section, which is provided with an inside screw thread 8. Correspondingly the container forming the medium reservoir has an open neck area provided with an outside thread.

Coaxially to the pumping axis P, which also forms a median longitudinal axis of the dosing device 1, the casing part 2 is provided with an inlet connection 3 projecting in the direction of the not shown medium reservoir. In the flow direction of the medium, upwards in the drawing, the inlet connection 3 continues into a substantially cylindrical reception sleeve section 11, which is open at the top.

In a manner to be described hereinafter, a pumping device 4, whose parts are oriented coaxially to the pumping axis P, is held in the casing part 2. Relative to the medium flow direction, at the outlet side the pumping device 4 is provided with an applicator 5, which in the embodiment shown is in the form of a nose olive. The applicator 5 is manufactured in dimensionally stable manner from plastic and in step-like manner has radially outwardly projecting finger support sections 6 shaped integrally on the applicator 5.

The casing part 2 has several guide webs 7 distributed uniformly over the circumference of the casing part 2 and which within certain limits are constructed so as to be elastically radially inwardly flexible. The guide webs 7 are provided in the vicinity of their upper ends with locking webs 9, which constitute plug connection sections in the sense of the invention.

Below the finger support sections 6, the applicator 5 is provided with an annular flange, projecting towards the casing part 2 and oriented coaxially to the pumping axis P and which in the vicinity of its lower edge is provided with inwardly projecting locking webs 10 corresponding to the locking webs 9. These also form plug connection sections in the sense of the invention. The locking webs 9, 10 also constitute an axial locking means in order to keep the applicator 5 on the casing part 2. As a result of the guide webs 7, the applicator 5 is mounted in stroke-movable manner relative to the casing part 2.

The previously mentioned pumping device 4 is positioned within the casing part 2 and the applicator 5 and is provided with a dimensionally stable pumping body 13, which continues towards the inlet connection 3 in the form of an elastically flexible bellows spring 12. At its end facing the inlet side, the bellows spring 12 has a torus, which is locked in axially secured manner below a constriction 16 of the reception sleeve section 11. The torus on the one hand and the constriction 16 on the other also form plug connection sections in the sense of the invention.

Radially within the guide webs 7, the casing part 2 is provided with a coaxially upwardly projecting inner ring area, which in the vicinity of its upper front edge is provided with a circumferential or several circumferentially distributed axial locking lugs 14. The dimensionally stable pumping body 13 has a corresponding, radially outwardly projecting annular shoulder 15, which together with the axial locking lugs 14 forms an upper axial stop for a pumping mobility of the pumping body 13. The inner ring with its inner wall faces simultaneously forms an axial guide for the pumping mobility of the pumping body 13. The inner ring, axial locking lugs 14 and annular shoulder 15 also serve as plug connection sections in the sense of the invention.

The pumping body 13 in the form of a hollow body and which is upwardly open to the applicator 5 is provided with an upper frontal edge area 21, which tapers conically to its end. Correspondingly the applicator 5 has a tapering inner wall, so that the pumping body 13 and applicator 5 form a flush, terminating plug connection. In order to axially secure the plug connection between the pumping body 13 and the applicator 5 in the fitted position, below the frontal edge area 21 the pumping body 13 is provided with a torus, with which is associated in the vicinity of the inner wall of the applicator 5 a corresponding annular groove. The torus and annular groove form an axially acting plug locking means between the pumping body 13 and applicator 5. The front edge area 21, inner wall area of applicator 5, torus and annular groove, forming the plug locking means 23, are also plug connection sections in the sense of the invention.

The applicator 5 is open to its upper end. In the vicinity of said upper end is provided an application opening, here in the form of a spray nozzle 32. A filler 26 is firmly positioned in the upper cavity area of the applicator 5 and extends coaxially into the vicinity of the pumping body 13. In the present case the filler 26 is pressed into the applicator 5. In the vicinity of the pumping body 13, the filler 26 is enveloped by a further bellows spring 29, which is inserted on the one hand into the open front edge area 21 of the pumping body 13 and into the cavity area of the applicator 5 on the other. In the area in which the bellows spring 29 is inserted in the applicator 5, the cavity of the latter has axial profilings 33, which fix an inelastic top area of the bellows spring 29 and prevent the latter from turning as a result of torsional forces. The bellows spring 29 is also only inserted in the applicator 5 and in the pumping body 13, without the provision of additional fixing means.

The end of the front edge area 21 of the pumping body 13 is provided with circumferential serrations 22. A radial shoulder area in the interior of the applicator 5 has corresponding circumferential serrations, so that the pumping body 13 is held in twisting-prevented manner in the applicator 5. The profilings 33 and circumferential serrations 22 also form plug connection sections in the sense of the invention.

In a lower end area spaced from the inelastic holding or top area of the upper bellows spring 29, a subsequently described outlet valve 24, constructed as a valve disk, is integrally shaped onto said spring 29. The outlet valve 24 cooperates with a shoulder-like valve seat 35 of the pumping body 13 in a manner to be described hereinafter. The outlet valve 24 has a radial, annular, cylindrical sealing section projecting into the pumping area which is sealingly engaged in the hollow cylindrical, upper region of the pumping area. In addition, above the radial sealing section, is provided a conically widening sealing area, which cooperates with a conical valve seat 35. This additionally provides an axially acting sealing effect.

Both the upper bellows spring 29 and the lower bellows spring 12 are constructed as compression spring accumulators.

The lower bellows spring 12 and the pumping body 13 form a through pumping area. Coaxially within the pumping area, the pumping body 13 contains an axially movable plunger 17, which in its lower end region forms an inlet valve together with the valve seat section of the casing part 2. For this purpose is provided in the lower end region of the plunger 17 a radially outwardly projecting disk ring section 19, with which is associated on the casing part 2 a correspondingly designed, annular valve seat 18.

Between the outlet valve 24 integrally shaped onto the bellows spring 29 and the elastic area of said bellows spring 29, in the latter are provided several radial openings 34, through which the medium can flow into the interior of the spring 29. The main flow path for the medium is outside the bellows spring 29 between the latter and the inner wall of the applicator 5 towards the filler 26. At the filler 26 are provided flow channel sections 30, which guide the medium to the outlet opening 31 and into the spray nozzle 32. The cavity within the applicator and the filler 26 within the bellows spring 29, together with the outer contour of said bellows spring 29 form up to the application opening, i.e. up to the spray nozzle 32, flow path sections for guiding the medium towards said spray nozzle 32. Together with the spray nozzle 32, an end of the filler 26 forms an outlet opening 31.

In the position of the dosing device 1 shown in the drawing all the valves, i.e. inlet valve 18, 19 and outlet valve 24 are shown in their closed position. The outlet valve 24 is held in this closed position by the compressive force of the upper bellows spring 29. The applicator 5 is in its upper end position relative to the casing part 2. The applicator 5 is held in this upper lift position by the compressive force of the lower bellows spring 12, which holds the pumping body 13 in its upper lift position relative to the inner ring of the casing part 2.

As soon as an operator presses the applicator 5 downwards relative to the casing part 2 by corresponding manual pressure on the finger support sections 6, the air trapped by the cavity within the bellows spring 12 and within the pumping body 13 is compressed. As a result of the pressure rise in the interior of the pumping chamber, i.e. the interior of the bellows spring 12 and the pumping body 13, the plunger 17 is held in its position closing the inlet valve.

In the starting position of the dosing device 1, as shown in the drawing, the spacing of the upper end 20 of the plunger 17 relative to an adjacent, lower, inlet-side face 25 is much smaller than the maximum stroke of the applicator 5 relative to the casing part 2. This maximum stroke is upwardly limited by the corresponding locking webs 9, 10 on the casing part 2 on the one hand and the applicator 5 on the other. In the downwards direction, on the casing part 2 is provided a circumferential stop shoulder 36, against which strikes a lower front edge area of the annular flange of applicator 5.

Thus, on compressing the pumping chamber by pressing down the finger support section 6, the end 20 of the plunger 17 encounters the inlet-side face 25 of the outlet valve 24, so that the latter is mechanically raised from its closed position. In said closed position there is a radial sealing seating in the vicinity of the cylindrical sealing section of the outlet valve 24, so that axially it is necessary to overcome a force closure between the inner wall of the pumping area and the sealing section of the outlet valve. In the closed position shown in the drawing, an upper, outlet-side face 28 of the outlet valve 24 is also spaced from a lower face 27 of the filler 26, so that the axially fixed filler 26 initially does not impede the raising of the outlet valve 24. The compressed air can now flow through and laterally past the opened outlet valve 24 and may pass through the radial openings 34 into the interior of the bellows spring 29. However, as a result of its limited density, it will particularly pass outwards along the bellows spring 29 and is directed via the axial profilings 33 to the corresponding flow groove sections 30 of filler 26. The flow groove sections 30 of filler 26 are constructed in through manner to an upper end of the filler 26. On removing the pressure load on the finger support sections 6, the lower bellows spring 12 presses the applicator 5 and pumping body 13 back into the starting position according to the drawing. Thus, within the pumping chamber, is necessarily formed a vacuum, which as a result of the then higher pressure of the medium in the medium reservoir, forces the plunger 17 upwards and brings about an inflow of medium, preferably a liquid or gel, into the pumping chamber. Through several operating processes all the pumping chamber air is displaced, so that medium dosing can commence. The pumping processes taking place at the outset and which are used for displacing the air from the dosing device 1 are referred to as priming.

The sum of the spacings of the end 20 of plunger 17 with respect to the inlet-side face 25 of the outlet valve 24 and the front side 27 of the filler 26 to the outlet-side face 28 of the outlet valve 24 is smaller than the maximum stroke of the pumping device 4. The maximum stroke of the pumping device 4 is defined by the maximum stroke of the applicator 5 relative to the casing part 2, as has been stated hereinbefore. On pressing down the finger support section 6 by the manual action of an operator, shortly before the end of the stroke, the plunger 17, outlet valve 24 and filler 26 run against a block, so that in this position necessarily the inlet valve 18, 19 is closed and the outlet valve 24 opened.

The outlet valve 24 limits the pumping area of the pumping device 4 at the outlet side, i.e. downstream. The inlet-side limitation is brought about by the inlet valve 18, 19.

The invention claimed is:

1. Dosing device for at least one medium with a casing part connectable to a medium reservoir, with a pumping device located in the casing part and with an applicator connected to the pumping device, said pumping device having at least one inlet valve, as well as at least one outlet valve associated with the applicator and a stroke-movable pumping body, wherein the casing part, applicator and all parts of the pumping device are provided coaxially to a pumping axis with plug connection sections by means of which the casing part, applicator and the parts of the pumping device can be assembled ready for functioning along the pumping axis to form the dosing device, wherein the pumping body and a bellows spring elastically returning the pumping body following a pumping movement are constructed as a common, integral continuous hollow body being open at two opposing ends and forming a common pumping area for the medium.

2. Dosing device according to claim 1, wherein a plunger arranged coaxially in the pumping area and which forms the inlet valve for the pumping area is provided as part of the pumping device.

3. Dosing device according to claim 1, wherein in particular at the outlet side of the pumping area is provided an outlet valve.

4. Dosing device according to claim 3, wherein the outlet valve is integrally shaped onto an outlet-side bellows spring.

5. Dosing device according to claim 3, wherein the outlet valve has a sealing section acting radially to the pumping axis.

6. Dosing device according to claim 5, wherein additionally an axially acting sealing area is provided at the outlet valve.

7. Dosing device according to claim 2, wherein an axial spacing of the plunger with respect to the outlet valve, in each case in their closed position, is smaller than a maximum operating stroke of the pumping device.

8. Dosing device according to claim 1, wherein the applicator and pumping body are circumferentially engaged to one another so as to prevent twisting.

9. Dosing device according to claim 1, wherein all parts of the pumping device, applicator and casing part are made from plastic.

10. Dosing device according to claim 1, said pumping device further comprising a plunger forming said inlet valve and engaging said outlet valve to open said outlet valve during said pumping movement.

11. Dosing device for at least one medium with a casing part connectable to a medium reservoir, with a pumping device located in the casing part and with an applicator connected to the pumping device, said pumping device having at least one inlet valve, as well as at least one outlet valve associated with the applicator and a stroke-movable pumping body, wherein the casing part, applicator and all parts of the pumping device are provided coaxially to a pumping axis with plug connection sections by means of which the casing part, applicator and the parts of the pumping device can be assembled ready for functioning along the pumping axis to form the dosing device, wherein the pumping body is integrally formed with a bellows spring, forming a hollow body defining therein a continuous medium flow path from the inlet valve to the outlet valve.

* * * * *